United States Patent [19]

Matsune et al.

[11] Patent Number: 4,764,854

[45] Date of Patent: Aug. 16, 1988

[54] MOUNTING DEVICE FOR REPLACEABLE LAMP ASSEMBLY ON REFLECTOR ENCLOSURE

[75] Inventors: Fusakiyo Matsune; Hidehiko Nagasawa; Hideharu Mochizuki, all of Shizuoka, Japan

[73] Assignee: Koito Seisakusho Co., Ltd., Tokyo, Japan

[21] Appl. No.: 923,589

[22] Filed: Oct. 27, 1986

[30] Foreign Application Priority Data

Nov. 1, 1985 [JP] Japan ..... 60-246055
Sep. 24, 1986 [JP] Japan ..... 61-225315

[51] Int. Cl.[4] ..... H01R 33/00
[52] U.S. Cl. ..... 362/226; 439/559
[58] Field of Search ..... 362/226, 267; 339/184 L, 184 M, 186 R, 186 M, 186 T; 313/318

[56] References Cited

U.S. PATENT DOCUMENTS 3,818,215 6/1974 Schmidt et al. ..... 240/41 R
4,100,448 7/1978 Chipner et al. ..... 362/267 X
4,427,255 1/1984 Cox ..... 362/296 X
4,500,946 2/1985 Mikola ..... 339/186 R X
4,622,486 11/1986 Endo ..... 313/115
4,634,920 1/1987 Rijckaert et al. ..... 313/318

*Primary Examiner*—Larry Jones
*Attorney, Agent, or Firm*—Browdy and Neimark

[57] ABSTRACT

A mounting device for mounting a replaceable lamp assembly having a flanged plug portion on a reflector enclosure. A generally tubular mounting tube is integrally projecting rearwards of the enclosure for receiving the lamp assembly and has a plurality of radially outwardly extending and circumferentially spaced projections on the rear end. An annular retaining ring having a radially inwardly extending retaining rim for abutting with the rear surface of a flange of the flanged plug portion of the lamp assembly, and a plurality of circumferentially spaced and radially inwardly projecting engaging rims to engage with the front surface of the projections on the mounting tube when the retaining ring is fitted on the mounting tube from the rear end and is rotated relative to the mounting tube.

10 Claims, 7 Drawing Sheets

MOUNTING DEVICE FOR REPLACEABLE LAMP ASSEMBLY ON REFLECTOR ENCLOSURE

FIELD OF THE INVENTION

The present invention relates to a mounting device for mounting a replaceable lamp assembly on a reflector enclosure and particularly, to the field of lighting device for use in a vehicle such as an automobile.

DESCRIPTION OF PRIOR ART

Conventional sealed beam head lamps in automobiles and the like usually comprise a replaceable lamp assembly and a reflector enclosure having a diffusion lens on the front end thereof. U.S. Pat. No. 4,500,946 shows a typical example, wherein a cylindrical mounting tube or socket is integrally formed on the rear end of the reflector enclosure for receiving replaceably therein a standardized lamp assembly which includes a quartz halogen filament lamp permanently attached to a rigid, generally cylindrical molded plug having a flange portion on the outer circumference thereof. A retaining ring defined in the specification as a knurled locking collar is fitted on the mounting tube with the flange portion of the lamp assembly being clamped between the mounting tube and the retaining ring. Several thread paths are circumferentially formed on the outer surface of the mounting tube, each of which includes an open end, a camming path and a closed end to cooperate with a projection formed on the inner circumference of the front edge of the retaining ring. The projection is defined as a thread path follower element. However, there are disadvantages in this construction in that the thickness of the circumferential wall of the mounting tube is locally decreased excessively due to the thread paths which decreases the strength of the mounting tube, and may cause cracks in the reflector enclosure, particularly when the enclosure is made of FRP. Further, the thread paths have generally L-shaped configuration; thus, it is required to utilize complicated die and mold to form this structure, thus increasing the manufacturing cost.

SUMMARY OF THE INVENTION

An object of the present invention is to overcome the shortcomings in the prior art devices and, according to the invention, there is provided a mounting device for mounting a replaceable lamp assembly on a reflector enclosure comprising: a mounting tube formed integrally on the rear end of the reflector enclosure for receiving therein a flanged plug portion of the lamp assembly, the mounting tube having a plurality of circumferentially spaced and radially outwardly extending projecting portions formed on the rear end of the outer circumference thereof, and a retaining ring having a generally cylindrical configuration and cooperating with the mounting tube for retaining the lamp assembly which is inserted into the mounting tube from the rear end thereof, the retaining ring having a radially inwardly extending retaining rim, and a plurality of radially inwardly projecting and circumferentially extending engaging rims, the engaging rims being adapted to engage with the projecting portions respectively when the retaining ring is fitted on the mounting tube with the flange portion of the lamp assembly bieng clamped by the retaining rim of the retaining ring.

According to the invention, the mounting tube does not have any excessively thin thickness wall portion, thus, it is possible to maintain ample mechanical strength even though the reflector enclosure is made of FRP. Further, the mounting tube may have a generally uniform wall thickness except for the projecting portions, thus, the strength is increased as compared with prior art.

The mounting tube of the invention can be formed by machining process, thus, the manufacturing cost is low.

Further, by providing a locking projection, assembled condition can reliably be maintained.

BRIEF DESCRIPTION OF THE DRAWINGS

FIG. 8 shows sectional configurations of locking projection and, FIG. 8A shows an optimum form, while.

BRIEF DESCRIPTION OF PREFERRED EMBODIMENTS

Figure 1:
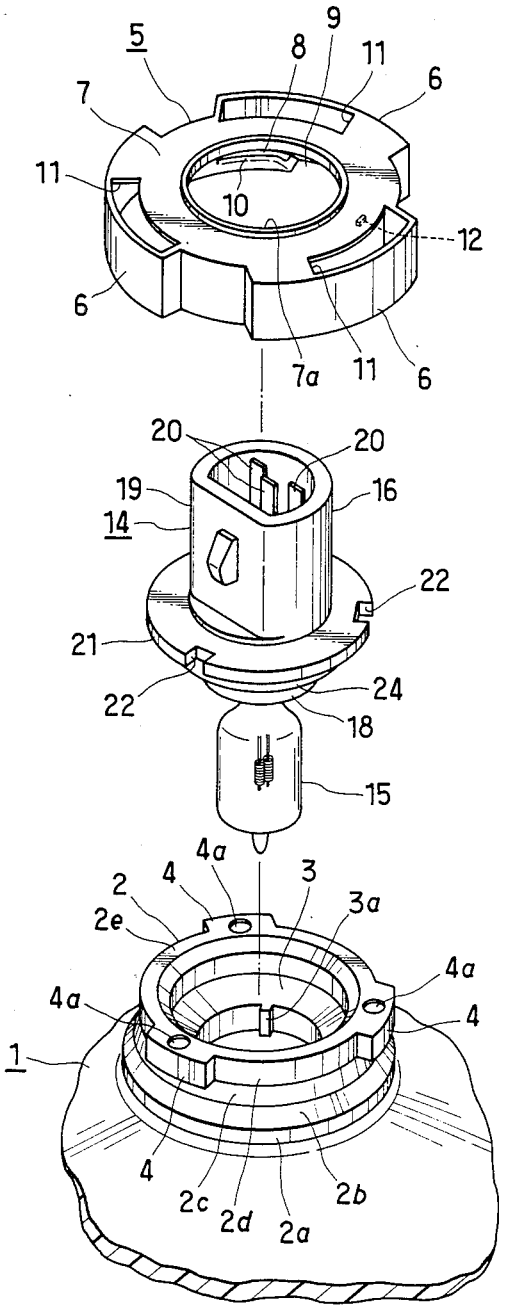
FIG. 1 is an exploded view of an embodiment according to the present invention.

A first embodiment of the present invention shown in FIGS. 1–10 comprises a reflector enclosure 1, a replaceable lamp assembly 14 and a retaining ring 5.

The reflector enclosure 1 (FIGS. 1–4) preferably formed of FRP (fiber reinforced plastics) and, a light reflecting surface is formed on the inner surface thereof by such as metal vaporizing, painting and the like. A lens (not shown) is provided on the front surface, and a mounting tube 2 is integrally formed on generally central portion of the rear surface to project rearwards therefrom. There are formed, on the outer circumference of the mounting tube 2, a generally cylindrical large diameter base portion 2*a*, a rearwards and radially inwardly inclined taper portion 2*b*, a second rearwards and radially inwardly inclined taper portion 2*c* with the inclination being gradual than that of the first taper portion 2*b*, a small diameter cylindrical portion 2*d*, and a plurality of circumferentially equally spaced radially outwardly extending projecting portions 4 on the rear end of the cylindrical portion 2*d*. The portions 2*a*, 2*b* and 2*c* can easily be formed by machining process, and increase the rigidity of the mounting tube, further, the taper portions 2*b* and 2*c* enable to increase the service life of cutting bites. A radially inwardly extending rim 3 is formed on the inner surface of the mounting tube 2.

The rear surface of the rim 3 is spaced from the rearmost surface 2*e* of the mounting tube 2 by a predetermined distance. One or more locating projection 3*a* is formed on the radially inner surface of the rim to engage with correspondingly shaped recess formed in the lamp assembly as explained in detail hereinafter. It will be understood that the reflector enclosure may not necessarily have integral reflecting element as explained heretofore, and the reflecting element may be a separate member. Further, the reflector enclosure is preferably a sealable member, but the present invention is not limited to the sealable reflector enclosure.

The retaining ring 5 (FIGS. 1–3 and FIGS. 5–8) has a generally cylindrical and relatively thin thickness configuration and, has on the outer peripheral wall a plurality of circumferentially equally spaced bulge portions 6, 6 and 6 having predetermined circumferential length respectively. A generally annular, radially inwardly extending retaining rim 7 is formed on the rear end of the retaining ring 5. In the embodiment, the rim 7 has on the radially inner edge a rearwards extending annular rounded projection 7*a* to increase the strength and to prevent the injury in handling the device. The retaining ring further has a plurality of radially inwardly projecting and circumferentially extending engaging rims 8, 8 and 8 on the front ends of the bulge potions 6, 6 and 6 respectively. Each engaging rim 8 extends from the counterclockwise end of each bulge portion 6 as viewed from the rear side, and has the circumferential length of about half of that of each bulge portion thereby forming a space 9 between the tip end of the engaging rim 8 and the clockwise end of the bulge portion 6. The circumferential length of the space 9 is slightly larger than that of each projecting portion 4 so that the projecting portion 4 can pass through the space 9 in assembling the retaining ring 5 on the mounting tube 2. The rear surface of the engaging rim 8 is tapered forwards at the clockwise end, such that the rim 8 can easily engage with the front surface of the projecting portion 4.

Rearwards projecting ridges 10,10 and 10 are formed on radially inner edges of engaging rims 8.

There are formed circumferentially extending openings 11,11 and 11 in the rear surface of retaining ring 5 at locations corresponding respectively to engaging rims 8 with the size of which being slightly larger than the engaging rims so that the mold for forming the retaining ring can be formed easily.

Figure 8A:
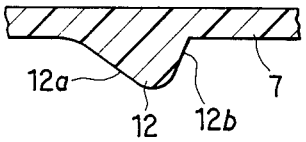
Figure 8B:
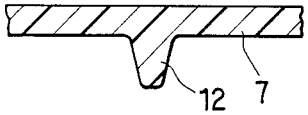
FIGS. 8B and 8C show undesirable forms.
Figure 8C:
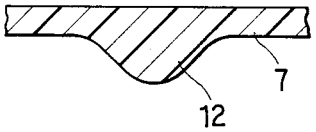
Figure 10:
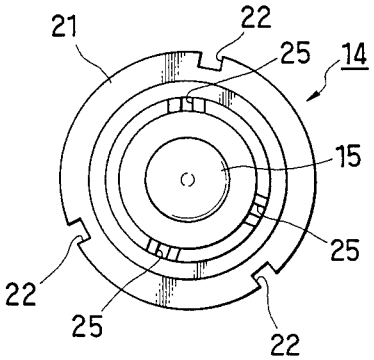
FIG. 10 is a front view of the lamp assembly.

At least one locking projection 12 is provided on the front surface of the retaining rim 7 and, the projection 12 has on circumferentially opposite sides inclined surfaces 12*a* and 12*b* as shown in FIG. 8A, and the surface 12*a* being gradual is on the side of locking direction, with the steep surface 12*b* being on the unlocking side. Thus, the retaining ring can easily be turned relative to the lamp assembly in the locking direction, and the locked condition can be maintained reliably. FIGS. 8B and 8C show undesirable forms wherein locking operation is too difficult or the retaining ring rotates easily to the unlocked condition. The projection 12 engages with either one of cutouts 22 in the outer circumference of lamp assembly 14 which will be described hereinafter.

A plurality of ridges 13, 13 and 13 are preferably formed on the front surface of the retaining rim 7 for engaging with the lamp assembly.

Incidentally, the retaining ring 5 may have any desired color but, preferably, have conspicuous color such as orange, yellow or green, particularly fluorescent color so that the lamp assembly can be exchanged easily even at night.

FIGS. 1–3 and FIGS. 9–10 show the lamp assembly 14, which comprises a glass or quartz bulb 15 having filaments therein and a plug portion 16 permanently attached to the bulb 15. The plug portion 16 is formed of synthetic resin and the like to have a generally cylindrical shape, and has a partition wall 17 to define a bulb retaining portion 18 at the forward and a connector portion 19 at the rearward. The rear end of the bulb 15 is attached to the bulb retaining portion 18 by such as cement and the like. The connector portion 19 retains therein terminals 20,20 and 20 which are connected respectively to filaments in the bulb 15 through lead wires not shown in the drawings.

A flange portion 21 is integrally formed on the outer circumference of the the plug portion 16 at generally mid portion in the lengthwise direction. A plurality of circumferentially equally spaced cutouts 22,22 and 22 are formed in the outer circumference of the flange portion 21 to cooperate with the projection 12 of the retaining ring 5. Further, an annular groove 23 is formed in the outer circumference of the plug portion 16 slightly forwards of the flange portion 21 for receiving a seal ring such as an O-ring 24.

Figure 9:
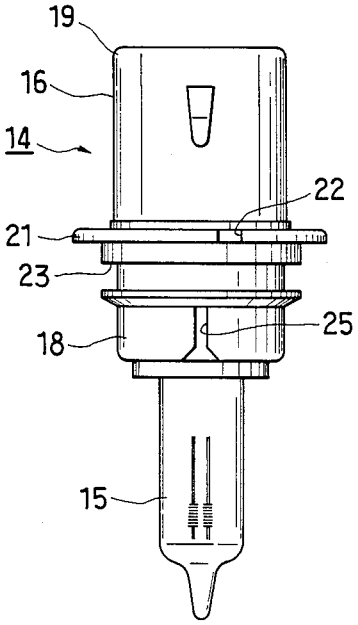
FIG. 9 is a side view of a lamp assembly.

A plurality of longitudinally extending grooves 25 (only one is shown in FIG. 9) are formed in the outer circumference of the forward end of the plug portion 16 to cooperate with the projections 3*a*, 3*a* and 3*a* of the mounting tube 2, thereby preventing relative rotation therebetween. It will be understood that the relative rotation is permitted in the second embodiment shown in FIGS. 11–15 with the projections 3*a* being omitted.

Figure 2:
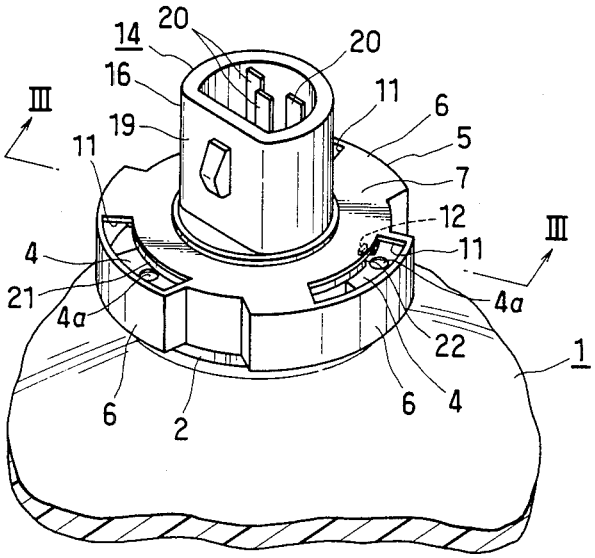
FIG. 2 is a perspective view showing an assembled condition.
Figure 3:
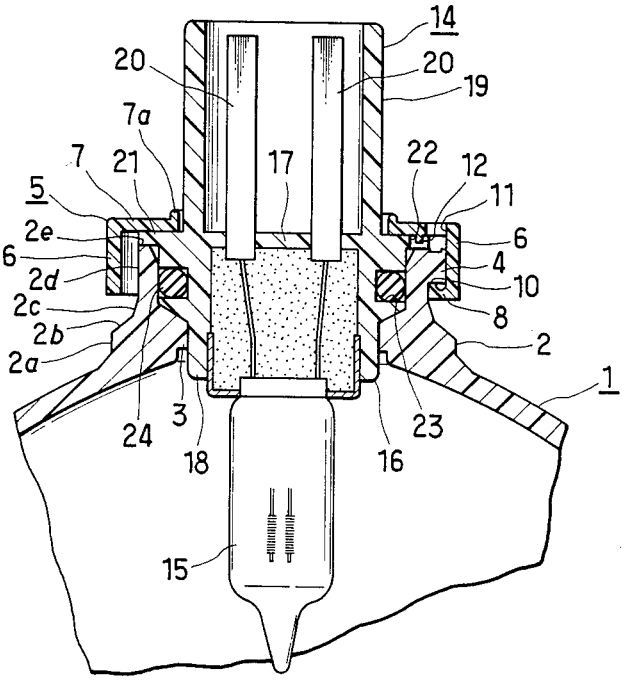
FIG. 3 is a section view taken along line III—III in FIG. 2.

The mounting operation will hereinafter be explained with reference to FIGS. 1–3. The lamp assembly is mounted on the reflector enclosure in the following manner.

Firstly, the bulb 15 of the lamp assembly is inserted into the reflector enclosure 1 from the rear end of the mounting tube 2 with the rotation preventing grooves 25 fitting respectively with locating projections 3*a* on the inner circumference of the mounting tube 2. There are formed on the rear surface of projecting portions 4 markings such as recesses or the like 4*a*, 4*a* and 4*a* such that the grooves 25 align respectively with projections 3*a* when cutouts 22 in the lamp assembly are aligned with the markings 4*a* respectively, thus, it is very easy to align the grooves 25 with projections 3*a* in inserting the lamp assembly into the mounting tube.

Next, the retaining ring is fitted on the plug portion from the rear end, so that the ridges 13 on the front surface of the retaining rim 7 of the retaining ring 5 engage with the rear surface of the flange portion 21 of the lamp assembly 14. The retaining ring is, at the same time, fitted on the mounting tube 2, with the projecting portions 4 passing respectively through the spaces 9 in the retaining ring 5, until the tip ends of engaging rims 8 face the front surfaces of projecting portions 4. Then, rotates the retaining ring in clockwise direction relative to the mounting tube 2, with the engaging rims 8 engaging the front surfaces of the projecting portions 4, until one circumferential ends of projecting portions engage corresponding inner circumferential walls of the bulge portions 6 respectively. The ridges 10 are formed on the radially inner edges of the engaging rims 8, the ridges resiliently engage with the radially inner ends of the projecting portions 4.

The locking projection 12 engages either one of cutouts 22 in the outer circumference of the flange portion 21 of the lamp assembly 14, thus, the rotation of retaining ring 5 is reliably prevented.

In disassembling the lamp assembly from the reflector enclosure 1, the retaining ring 5 is counterclockwisely rotated with the locking projection 12 being forcibly disengaging from the cutout 22, thereafter, the lamp assembly 14 is retracted rearwards.

FIGS. 11–15 show a second embodiment of the present invention, wherein parts corresponding to the embodiment of FIGS. 1–10 are depicted by the same reference numerals and the description therefor is omitted.

Figure 4:
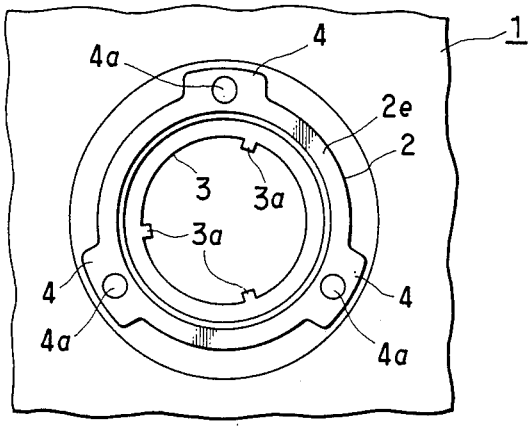
FIG. 4 is a rear view of a mounting tube.
Figure 5:
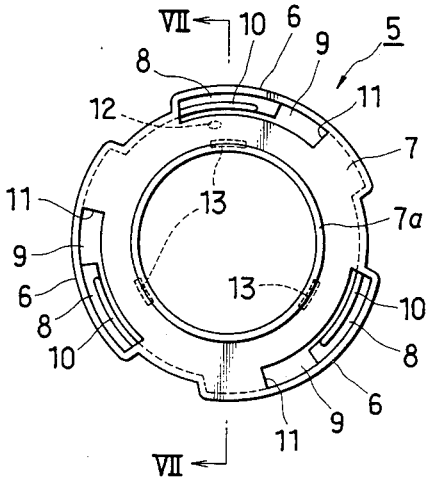
FIG. 5 is a rear view of a retaining ring.
Figure 6:
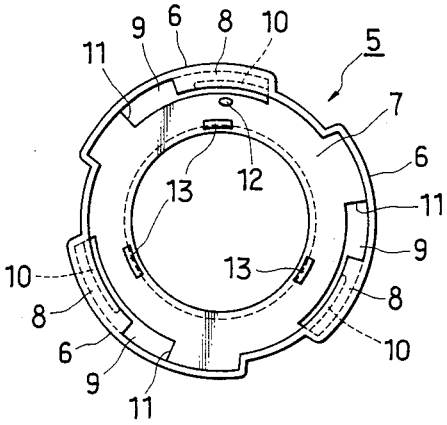
FIG. 6 is a front view of the retaining ring.
Figure 7:
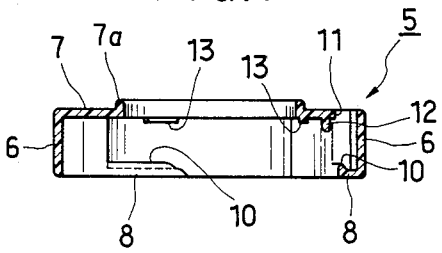
FIG. 7 is a section view taken along line VII—VII in FIG. 5.
Figure 11:
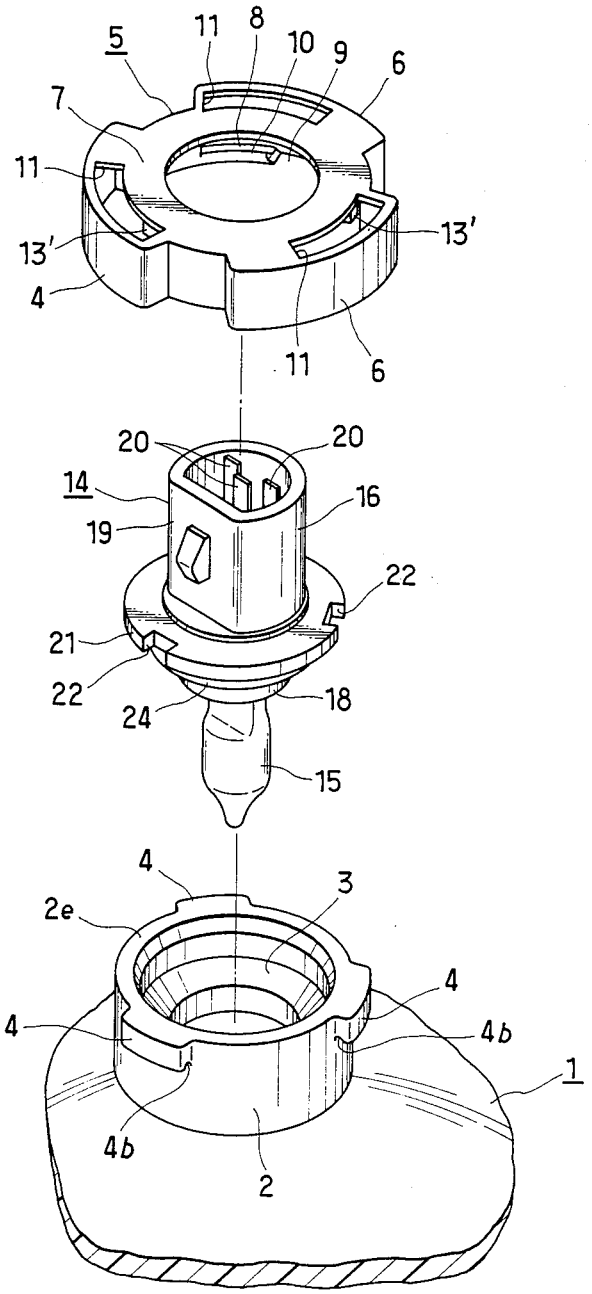
FIG. 11 is an exploded view of a second embodiment according to the present invention.
Figure 12:
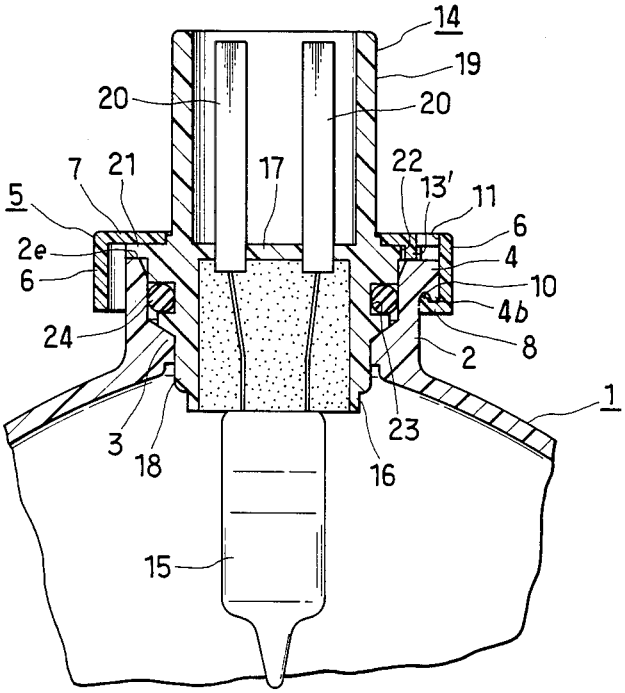
FIG. 12 is a sectional view similar to FIG. 3.

In the second embodiment, the locating projections 3*a* on the inner circumference of the mounting tube 2 shown in FIGS. 1 and 4 are omitted, thus, the relative rotation between the mounting tube 2 and the lamp assembly 14 is permitted. In FIGS. 11 and 12, the locating grooves 25 in the lamp assembly 14 are omitted, however, the lamp assembly may have such grooves.

The relative rotation between the retaining ring 5 and the lamp assembly 14 is prevented by a plurality of projections 13′ formed on the front surface of the retaining rim 7 and engaging respectively with the cutouts 22 in the flange portion 21 of the lamp assembly 14. Accordingly, firstly in the assembling process, the retaining ring 5 is fitted on the lamp assembly 14 with the projections 13′ engaging the cutouts 22, thereafter, the lamp and the retaining ring are fitted as a unit on the reflector enclosure.

Figure 13:
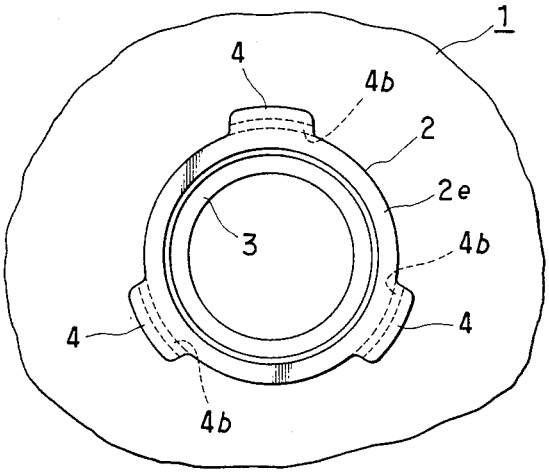
FIG. 13 is a rear view of the mounting tube in FIG. 11.
Figure 14:
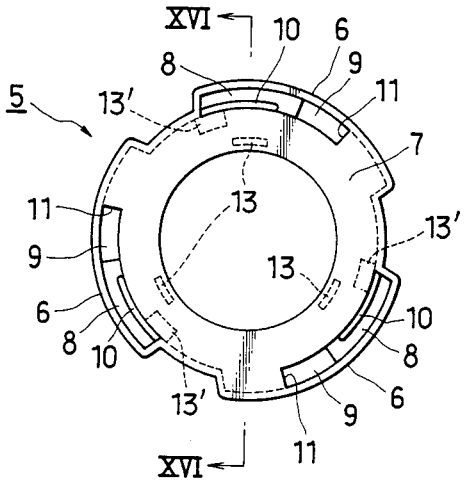
FIG. 14 is a rear view of the retaining ring in FIG. 11.
Figure 15:
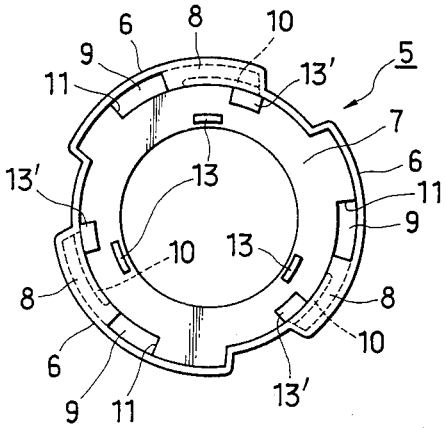
FIG. 15 is a front view of the retaining ring in FIG. 11.
Figure 16:
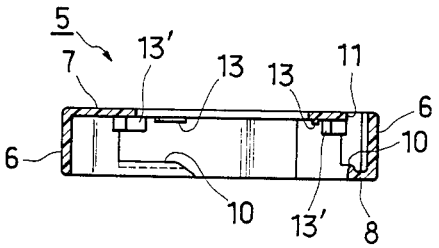
FIG. 16 is a sectional view of the retaining ring.

The engagement between the mounting tube 2 and the retaining ring 5 is generally similar to the first embodiment. There are formed in radially inner ends of the front surfaces of the projecting portions 4 of the mounting tube 2 arcuate grooves 4*b*,4*b* and 4*b* as shown in FIGS. 12 and 13 for engaging with the ridges 10 on the inner edges of the engaging rims 8, thus, the engagement between the mounting tube 2 and the retaining ring 5 is reliable as compared with the first embodiment.

It will be understood that the mounting tube 2 in the second embodiment is simply connected to the main part of the reflector enclosure 1 as compared with the first embodiment, however, when the reflector enclosure is made of FRP, the construction of the first embodiment is preferable with respect to the forward end portion of the mounting tube 2.

As described heretofore in detail, the mounting tube according to the invention does not have any excessively thin thickness wall portion, thus, it is possible to achieve ample mechanical strength even though the reflector enclosure is made of FRP. Further, the mounting may have a generally uniform wall thickness except for the projecting portions, thus, the strength and the durability of the reflector enclosure can be improved.

The locking projection according to the invention can maintain the assembled condition reliably and, if required, enables the exchange of the lamp assembly.

The reflector enclosure and the retaining ring of the invention can be formed of mold forming process of FRP, and of machining process on relatively little part, thus, the manufacturing cost can be reduced.

What is claimed is:

1. A mounting device for mounting a replaceable lamp assembly on a reflector enclosure, comprising: a mounting tube integrally formed on the rear end of the reflector enclosure for receiving a flanged plug portion of said replaceable lamp assembly therein, said mounting tube having on the rear portion of the outer circumference thereof a plurality of circumferentially spaced and radially outwardly extending independent projecting portions formed by machining; and a retaining ring having a generally cylindrical configuration and cooperating with the mounting tube for retaining the lamp assembly being inserted into the mounting tube from the rear end thereof, said retaining ring having a radially inwardly extending retaining rim, and a plurality of radially inwardly projecting and circumferentially extending engaging rims; said engaging rims being adapted to engage with said projecting portions respectively when the retaining ring is fitted on the mounting tube with the flange portion of said lamp assembly being clamped by the retaining rim of said retaining ring.

2. A mounting device according to claim 1, wherein at least one projection is formed on the front surface of the retaining rim of the retaining ring for engaging with at least one cutout formed in the outer circumference of the flange portion of the lamp assembly thereby preventing relative rotation therebetween.

3. A mounting device according to claim 1, wherein said flange portion of the lamp assembly has a plurality of circumferentially spaced cutouts for cooperating with said projection on the retaining rim of the retaining rim.

4. A mounting device according to claim 1, wherein said projection on the retaining rim is formed to have a steeply sloped surface on one circumferential end and a gradually sloped surface on the opposite circumferential end.

5. A mounting device according to claim 1, wherein at least one set of projection and corresponding groove is formed between the mounting tube and the lamp assembly for preventing relative rotation therebetween.

6. A mounting device according to claim 1, wherein said projecting portions of the mounting tube have respectively circumferential grooves in the front surface thereof and said engaging rims of the retaining ring has respectively corresponding circumferentially extending projections.

7. A mounting device according to claim 1, wherein said engaging rims of the retaining ring are formed to have inclined surfaces on respective one circumferential ends.

8. A mounting device according to claim 7, wherein said engaging rims are integrally connected to the retaining ring at the other circumferential ends.

9. A mounting device according to claim 1, wherein at least one projection is formed on the front surface of the retaining rim for engaging with the rear surface of the flange portion of said lamp assembly thereby retaining the lamp assembly.

10. A mounting device according to claim 1, wherein a marking is provided on the rear surface of at least one projecting portion of said mounting tube.

* * * * *